US006161674A

United States Patent [19]

Aulanko et al.

[11] Patent Number: 6,161,674

[45] Date of Patent: Dec. 19, 2000

[54] PEOPLE MOVER AND DRIVE APPARATUS

[75] Inventors: Esko Aulanko, Kerava; Tauno Pajala, Espoo; Simo Jokela, Hyvinkää, all of Finland

[73] Assignee: Kone Oy, Helsinki, Finland

[21] Appl. No.: 09/394,507

[22] Filed: Sep. 13, 1999

Related U.S. Application Data

[62] Division of application No. 08/808,692, Feb. 28, 1997, Pat. No. 5,950,797.

[51] Int. Cl.[7] ..... B66B 21/00

[52] U.S. Cl. ..... 198/330

[58] Field of Search ..... 198/330

[56] References Cited

U.S. PATENT DOCUMENTS

| | | |
|---|---|---|
| 3,658,166 | 4/1972 | Hara et al. . |
| 4,056,759 | 11/1977 | Mitsui et al. . |
| 4,775,044 | 10/1988 | Hofling . |
| 4,809,841 | 3/1989 | Kitamura . |
| 5,018,603 | 5/1991 | Ito . |
| 5,224,580 | 7/1993 | Nurnberg et al. . |
| 5,348,131 | 9/1994 | Yamaguchi et al. . |
| 5,379,877 | 1/1995 | Hoefling . |

FOREIGN PATENT DOCUMENTS

| | | |
|---|---|---|
| 585818 | 11/1934 | Germany . |
| 9315015 | 8/1993 | WIPO . |
| 9528028 | 10/1995 | WIPO . |

*Primary Examiner*—Joseph E. Valenza
*Assistant Examiner*—Khoi H. Tran

[57] ABSTRACT

A people mover such as an escalator or moving sidewalk is driven by a motor having a relatively small axial dimension and is configured to fit in available space, avoiding the need for a machine room for these components, thereby simplifying the incorporation of the people mover into a new or existing building design.

8 Claims, 5 Drawing Sheets

PEOPLE MOVER AND DRIVE APPARATUS

Figure 1:
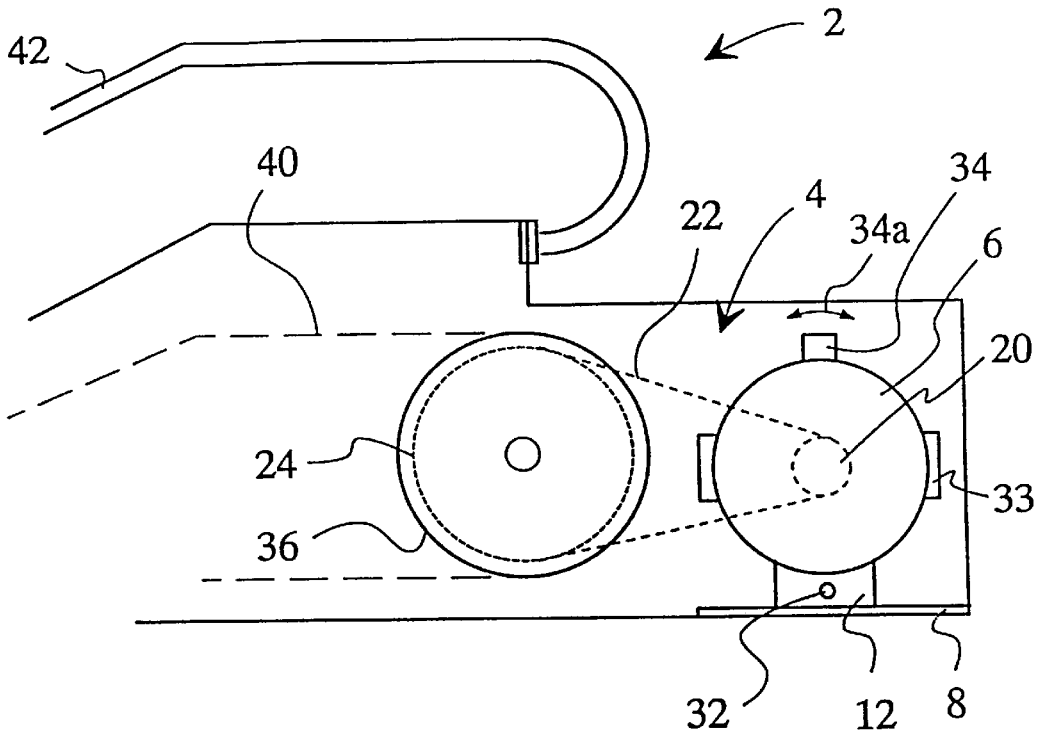

This application is a divisional of application Ser. No. 08/808,692, filed on Feb. 28, 1997, now U.S. Pat. No. 5,950,797, the entire contents of which are hereby incorporated by reference.

The present invention relates to a people mover as defined in the preamble of claim 1 and a drive apparatus as defined in the preamble of claim 5.

Examples of conventional people movers covered by the sphere of application of the present invention are escalators and moving sidewalks, in which the motion may take place in a horizontal plane or in an inclined direction.

Escalators are driven by a motor located at the upper or lower end of the escalator, driving the drive sprocket of the escalator by means of a gear, belts or chains. The drive sprocket is provided with a toothing designed to engage the step chains of the escalator.

Previously known escalator drive machines require a large space and have a complicated construction. Usually there is a fairly long machine space at one end of the escalator. This increases the total length of the escalator, making it more difficult to accommodate the escalator in the building and taking up building space. An example of such an escalator is found in U.S. Pat. No. 5,348,131, in which the machinery is placed at the upper end of the escalator. When a smaller total length of the escalator structure is aimed at, this will easily result in a close machine space at the end of the escalator and therefore more difficult installation and maintenance. U.S. Pat. No. 4,775,044 presents an escalator in which the machinery is placed inside the step track. In this solution, the machinery does not require any extra space at the ends of the escalator. However, because of this placement, the machinery is more difficult to access.

The object of the invention is to achieve a people mover and a drive apparatus for a people mover that are advantageous in respect of space utilization as well as ease of installation and maintenance. The people mover of the invention is characterized by what is presented in the characterization part of claim 1, and the drive apparatus is characterized by what is presented in the characterization part of claim 6. As for other important features of the invention, reference is made to the claims.

With the solution of the invention, in which the drive motor is an axial motor requiring only a small space in its axial direction, the machine room can be made smaller than before while still providing sufficient space for maintenance. With an axial motor, a sufficient torque is achieved without a gear, and the use of a frequency converter allows advantageous speed control. Chain tensioning can be effected by adjusting the upper fixing points of the machinery. The number of drive machines can be increased according to the torque needed.

In an embodiment in which the motor drives the step chain wheel directly, no machine room is needed for the machinery. Neither is a gear system needed when the torque requirement is low. For higher torques, it is possible to provide the motor with a gear coupled directly to the shaft of the step chain wheel or to add another motor to the shaft or increase the motor diameter. In conveyor belt drives and moving sidewalks, an increased torque requirement can be met by adding modular axial motors. Multiple machine units can be fitted in succession at suitable distances in the direction of motion of the conveyor belt or on the same shaft side by side. A separate machinery with an axial motor can be fitted for the handrail to drive it in separation from the step chain. Separate synchronous motors are easy to control so as to achieve mutually synchronized operation.

Figure 2:
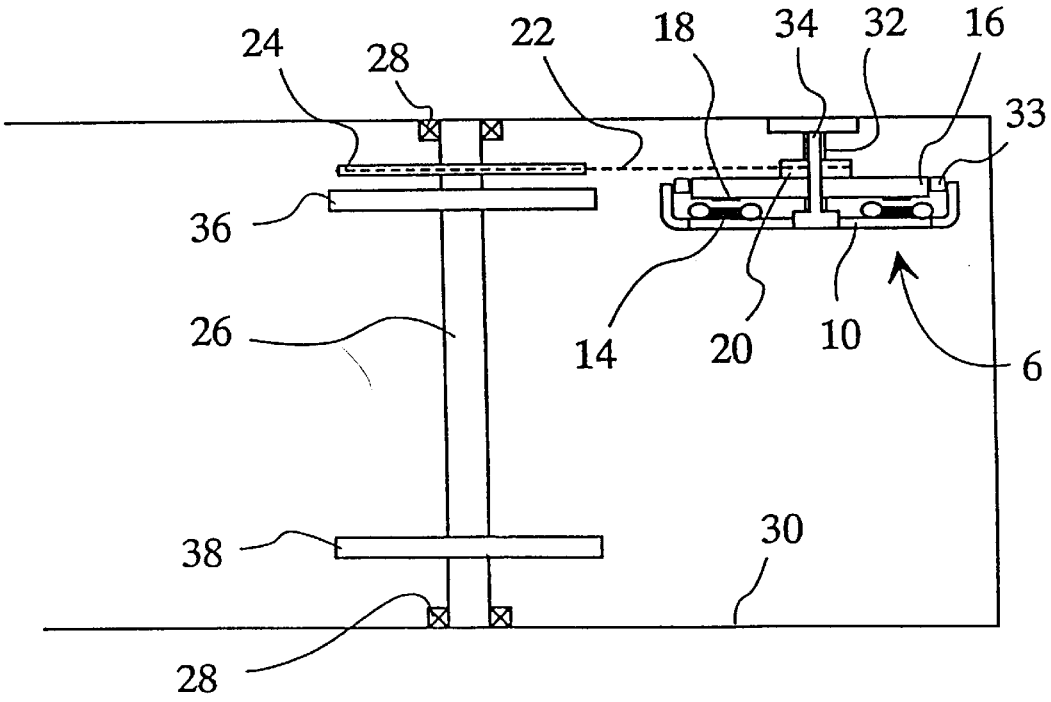
Figure 3:
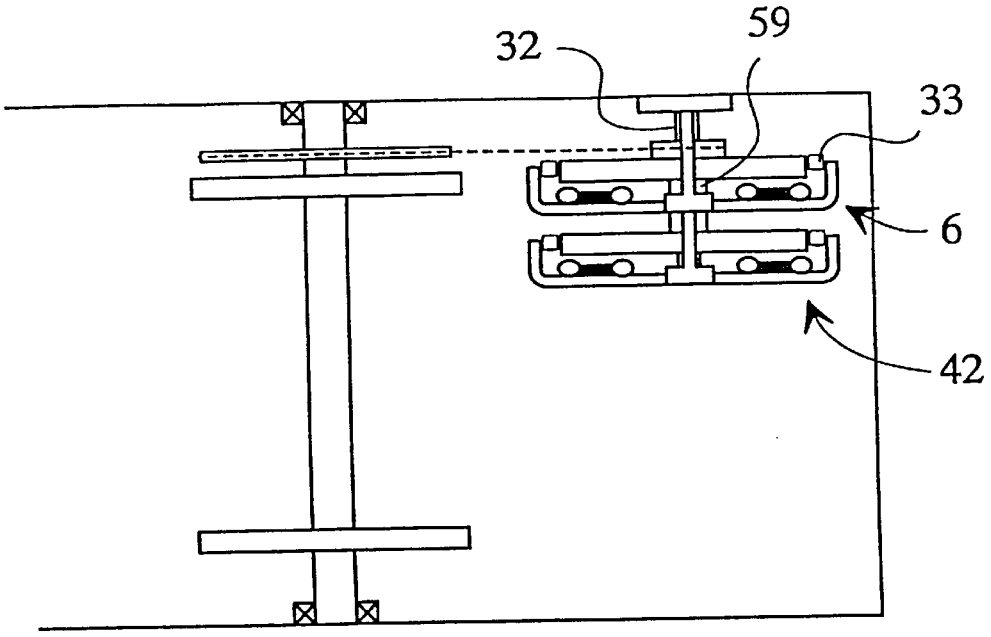
Figure 4:
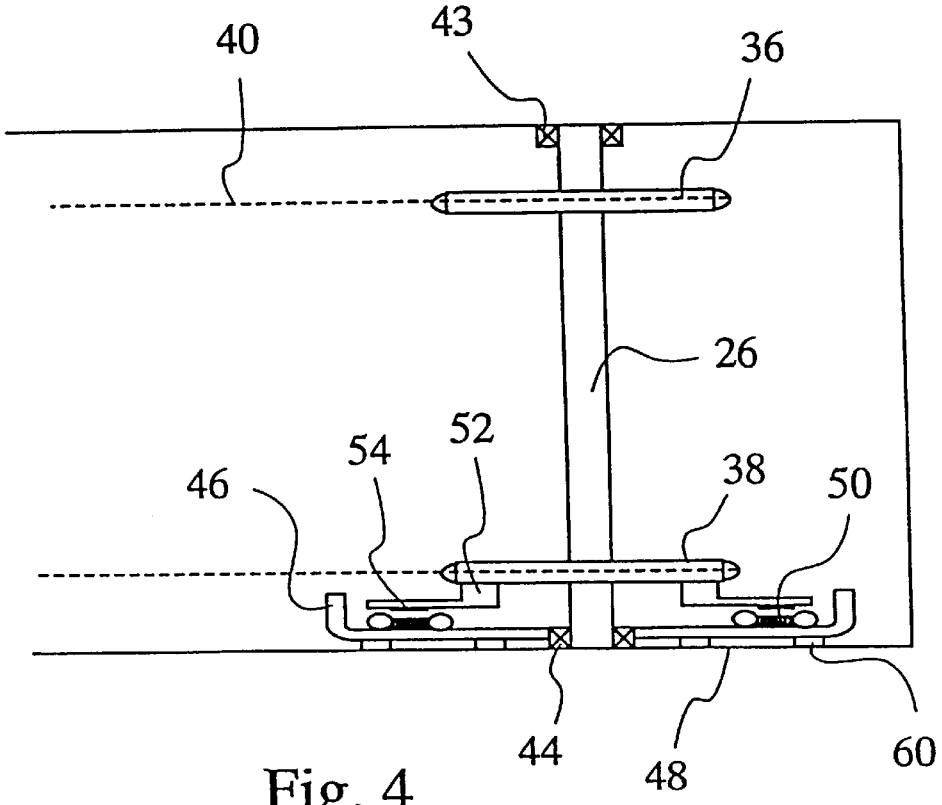
Figure 5:
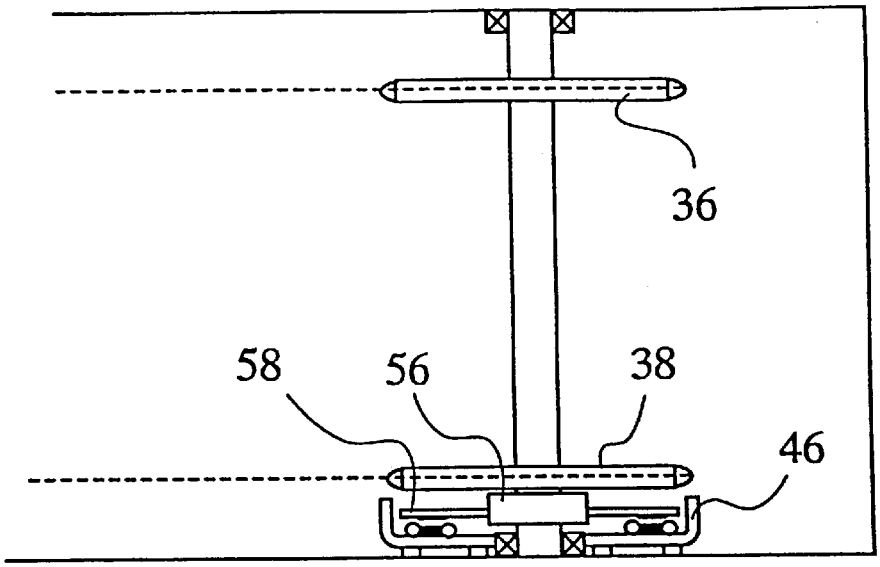
Figure 8:
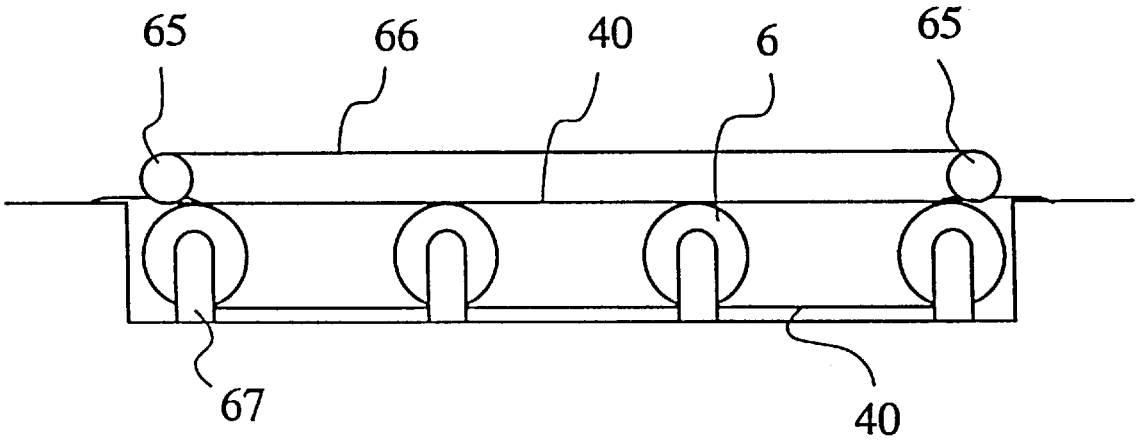
Figure 6:
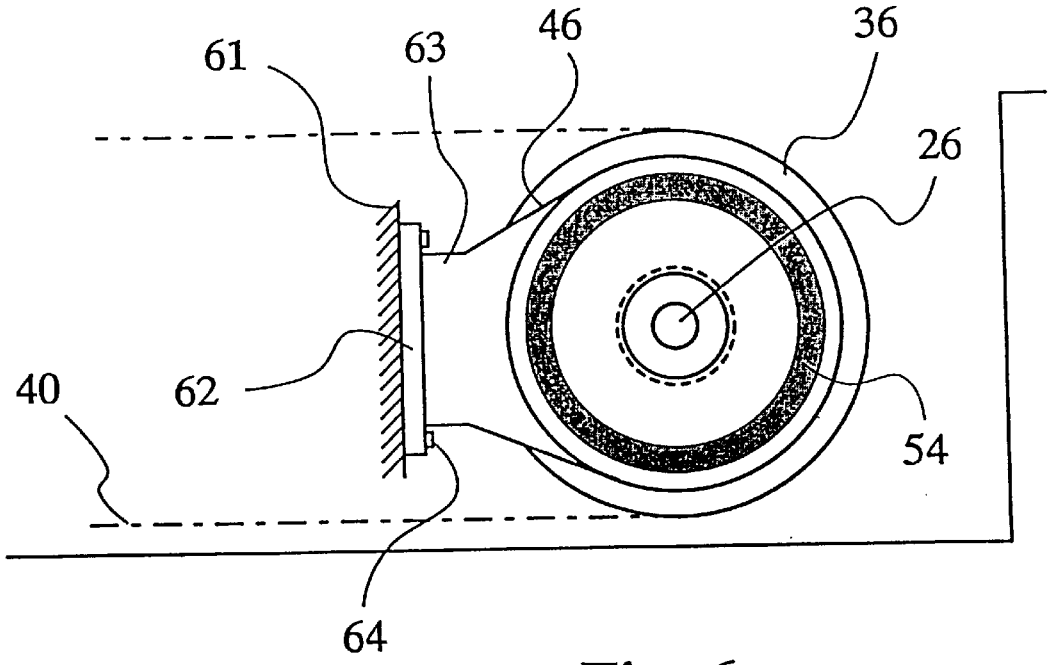
Figure 7:
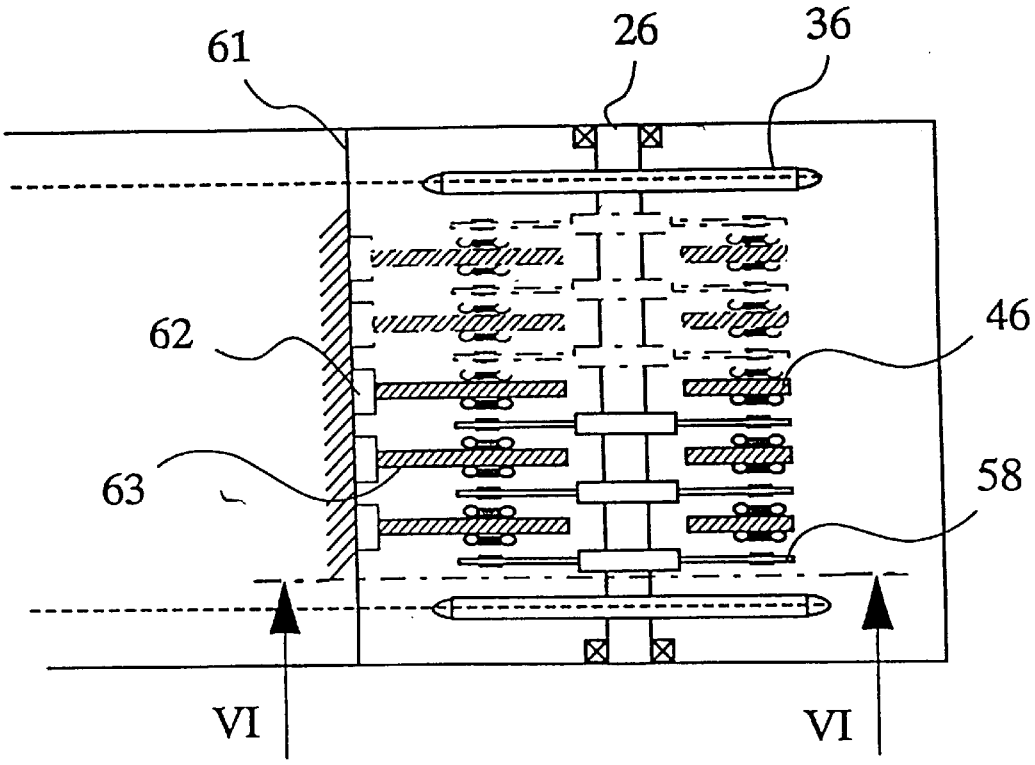
Figure 9:
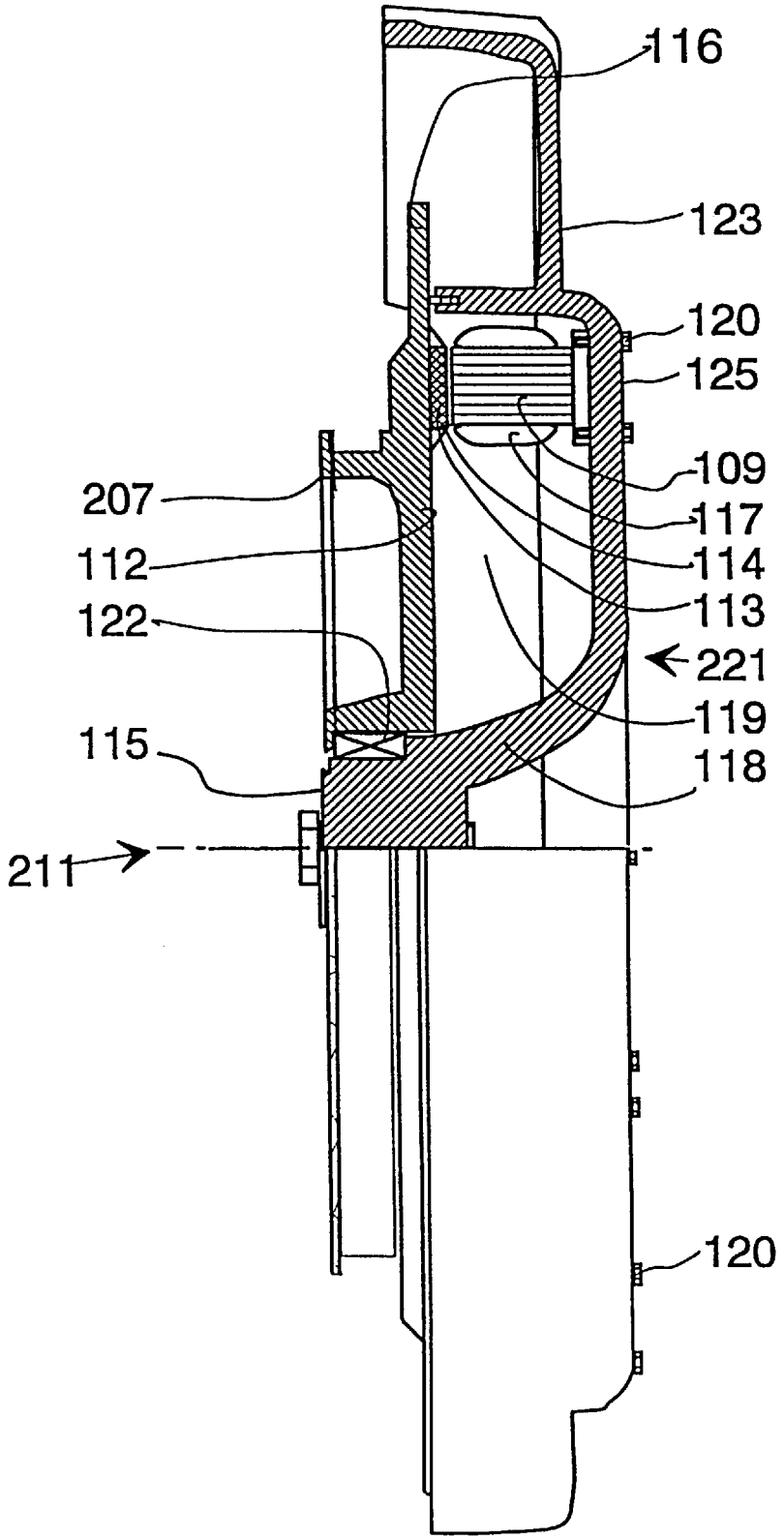

In the following, the invention is described by the aid of examples by referring to the attached drawings, in which FIG. 1 presents a first embodiment of the invention in side view, FIG. 2 presents the first embodiment of the invention in top view, FIG. 3 presents a second embodiment of the invention in top view, FIG. 4 presents a third embodiment of the invention in top view, FIG. 5 presents a fourth embodiment of the invention in top view, FIG. 6 presents a fifth embodiment of the invention in side view, FIG. 7 presents the fifth embodiment of the invention in top view, FIG. 8 presents an embodiment of the invention in which a moving sidewalk is provided with multiple motors in the direction of motion, and FIG. 9 presents an electric motor suited for use in applications of the invention.

The drive machine of an apparatus according to the first embodiment of the invention is depicted in FIG. 1 and 2.

The drive machine of the escalator 2 is placed in a machine room 4. The drive machine consists of a motor 6 whose stator 10 is supported by the machine room floor 8 via a frame part 12 and a joint 32. The motor 6 is preferably an axial-air-gap type motor, such as a permanent magnet synchronous motor or a commutating direct-current machine. In this case the motor is a permanent magnet synchronous motor, with stator windings 14 attached to the stator 10. The rotor 16 of the motor consists of an iron disc to which the permanent magnets 18 have been fixed close to the outer edge of the rotor disc, in the area opposite to the stator windings 14. Placing the permanent magnets and stator windings at the motor circumference ensures that a maximal torque is achieved. A possible embodiment giving a closer illustration of the motor and the placement of the magnets is described in more detail later on in connection with FIG. 9.

Attached to the middle of the rotor disc is a drive sprocket 20 acting as a mechanical output of the motor, with a drive chain 22 fitted on its circumference. The drive chain 22 runs around a toothed wheel 24 mounted on the axle 26 of the step chain wheel of the escalator. The axle 26 is mounted with bearings 28 on the supporting structures of the walls 30. Instead of walls, a separate supporting frame can also be used. The axial motor 10 can be so mounted that it can be turned as indicated by the arrow 34*a* about the joint 32 so as to allow the drive chain 22 to be adjusted to the correct tension. Mounted on the axle are also the step chain wheels or drive sprockets 36 and 38 of the conveyor track, the chains 40 of the conveyor track being fitted to run around said sprockets. Supported by the stator 10 is a brake 33 acting on the rotor 16. The conveyor track itself is constructed in a manner known from escalators and moving sidewalks. Fitted to run above the conveyor track are handrails, which are driven by means of the conveyor chains or a separate axial motor driving the drive wheel of the handrail belt.

In the embodiment illustrated by FIG. 3, to increase the torque of the drive machine, the escalator is provided with another similar axial motor 42 fitted on the same shaft of the drive machine 6. In other respects, the apparatus in FIG. 3 corresponds to that presented in FIG. 1 and 3, corresponding parts being indicated by the same reference numbers. In this case, the rotors 16 are connected via a coupling shaft 59. According to another alternative (not shown in the drawing), the second motor can also be provided with its own drive chain, in which case the second drive chain is mounted on a sprocket on the shaft of the second motor and passed around a second chain wheel fitted on the step chain wheel axle. The second drive motor is preferably placed on the opposite side of the machine room and the drive chain correspondingly close to the second step chain wheel 38. When two motors 2 are placed on the same shaft, they can also be mounted face to face.

According to an embodiment of the invention, the drive motor is mounted on the same axle with the step chain wheel. As illustrated by FIG. 4, one end of the step chain wheel axle 26, to which the step chain wheels 36 and 38 are fixed, is mounted with a bearing 43 on a supporting structure on one side of the conveyor, e.g. an escalator. The other end of the axle 26 is mounted with a bearing 44 on the stator 46 of the drive motor, the stator being fixed with hold blocks 60 to a supporting structure 48 on the other side of the conveyor. The hold blocks can be of a design enabling chain tensioning. As in the case of the machine in FIG. 2 and 3, the stator windings 50 are fixed to the stator in an area close to its circumference. Attached to the second step chain wheel 38 are the rotor parts 52, the rotor magnets 54 being fixed to the rotor parts in the area opposite to the stator windings 50. In the solution depicted in FIG. 4, it is possible to fit a drive motor in a corresponding manner to the other step chain wheel as well to provide more operating power.

FIG. 5 presents a solution corresponding to FIG. 4 with the difference that there is a gear system 56 fitted in the region of the rotor 58. A planetary gear is a preferable solution in respect of space utilization as well as other considerations. If the gear system is to have non-concentric primary and secondary sides, another type of gear will be more appropriate. The primary side of the gear is connected to the rotor 58 of the motor, while the power take-off of the gear is connected to the step chain wheel axle 26.

FIGS. 6 and 7 present a drive machine solution for a moving sidewalk, generally a sidewalk moving in a horizontal direction. Moving sidewalks are widely used e.g. at airports, where there is enough space for the machinery at the end of the moving sidewalk. In the solution of the invention, the step chain wheels 36 and 38 are fixed to an axle 26 mounted with bearings on the supporting structures of the sidewalk as in the solutions described above. The rotors 58 and stators 46 form a modular laminated structure consisting of a number of rotor/stator combinations, depending on the need in each case. In the solution illustrated by the figures, three rotors and stators placed side by side are used, depicted in solid lines. If this is not enough but a still higher torque is required, more rotor/stator combinations (depicted in dotted broken lines in FIG. 7) can be mounted side by side on the axle 26.

Each stator disc 46 is of an annular shape in the region of the stator windings, and this annular part is fixed to a stator leg 63, which is further provided with a mounting foot 62. Each stator disc is mounted on a fixed base 61 secured on the supporting structures of the moving sidewalk. As seen from the side, the whole drive machinery is enclosed within the loop formed by the step chain 40 and conveyor steps (not shown).

FIG. 8 presents a drive machine solution suited for a long moving sidewalk. Depending on the length of the moving sidewalk, one or more motors 6 are needed. In this solution, the motors 6 are placed at equal distances over the length of the conveyor, yet so that there is at least one motor at each end. As the motors are synchronous machines, they can be run at the same speed from a single control system. There may be one, two or more motors in parallel on the same axle, as illustrated e.g. by FIG. 6 and 7. When two motors are mounted on the same axle, their stators can be fixed to the side walls of the moving sidewalk. The stators can also be fixed to the floor of the moving sidewalk by means of supporting legs 67.

The drive motor of the handrails 66 may also consist of a thin axial motor 65, in which case the rotor of the axial motor also constitutes a diverting pulley at the end of the handrail. The control of the handrail is implemented using the same control system as is used for the control of the drive motors, to ensure that the handrail will run at the same speed as the conveyor.

In FIG. 9, the electric motor is presented in a view sectioned along a plane starting radially upward from the axis of rotation 211. Connected to the motor is a toothed drive wheel 207. For better readability of the figure, the motor is presented in a form magnified in its axial direction. In reality, the motor is flat in the axial direction. The motor 221 comprises a rotor 113 mounted on a rotor disc 112 and a stator 109 mounted on a stator disc 118. The rotor of this motor is implemented using permanent magnets. Between the rotor and stator there is an air gap 114 in a plane substantially perpendicular to the motor shaft 115. The stator with the stator winding 117 is of an annular structure and the stator with the stator windings is placed in an annular cavity 119 in the stator disc 118, said cavity being open on one side. The stator is fixed to the cavity wall 125 perpendicular to the axis by means of fixing elements, preferably screws. In principle, the stator can be fixed to any wall of the cavity. The cavity consists of an annular trough in the stator disc, with the open side of the trough facing towards the rotor disc 112, thus forming an annular cavity between the stator disc and rotor disc. Attached to the rotor disc 112 is an annular brake disc 116 forming a radial extension of the circumference of the rotor disc, said brake disc being oriented in the radial direction of the rotor. The annular brake disc may be integrated to form a single part with the rotor disc. The disc brake (not shown in the figures) is mounted on both sides of the brake disc 116 so as to permit floating of the brake in the axial direction of the shaft 115.

Attached to the rotor disc 112 is a cylindrical, toothed drive wheel 207. The diameter of the drive wheel is smaller than the diameter of the circle formed by the rotor bars 113 on the rotor disc and the diameter of the circle formed by the stator 109 on the stator disc. The rotor disc 112, drive wheel 207 and brake disc 116 are integrated to form a single part. Thus, the brake disc is a substantially immediate extension of the rotor disc, yet with a narrow annular area for a sealing between the rotor bars and the brake disc.

The stator disc 118 and the shaft 115 are likewise integrated to form a single part, which also constitutes the frame of the motor. The assembly consisting of the stator disc 118 and the shaft 115 is preferably made of a casting, which is also provided with a lug 123. Bearings 122 are provided between the rotor disc and stator disc. There is also an annular sealing between the rotor and stator discs. The sealing stop face on the rotor disc lies between the rotor bars and the brake disc. The sealing seals the cavity 119 to render it a closed space, preventing dust from penetrating into the space. The sealing may consist e.g. of a felt seal.

It is obvious to a person skilled in the art that the invention is not restricted to the examples described above, but that the invention may instead be varied in the scope of the claims presented below.

What is claimed is:

1. A people mover comprising:

a people supporting track such as an escalator or a moving sidewalk arranged to move in a desired direction;

a pair of supporting structures extending adjacent to said people supporting track and parallel to the desired direction of movement thereof with the people supporting track disposed therebetween;

a drive apparatus formed of plural drive motors, each drive motor including a motor rotor, and a drive wheel directly driving the people supporting track, the motor rotors and said drive wheel being mounted coaxially and rotating with each other, said drive motors, in the axial direction, being substantially thin in construction.

2. The people mover of claim 1 wherein said drive apparatus includes two co-axial drive wheels;

each said drive wheel being adjacent one of said pair of supporting structures with said plural drive motors being coaxially located between said two drive wheels.

3. The people mover of claim 1 wherein said drive motors are electric motors.

4. The people mover of claim 8 wherein said people mover further includes at least one handrail; and a handrail drive apparatus driving said handrail in the same direction and at substantially the same speed as said people supporting track.

5. A people mover comprising:

a people supporting track such as an escalator or a moving sidewalk arranged to move in a desired direction;

a pair of supporting structures extending adjacent to said people supporting track and parallel to the desired direction of movement thereof with the people supporting track disposed therebetween;

plural drive apparatus formed of a drive motor including a motor rotor, and a drive wheel directly driving the people supporting track, each said drive wheel being mounted coaxially to and for direct rotation with its associated motor rotor and imparting motion from said drive motor to said people moving track;

said plural drive apparatus being spaced along said people supporting track in said desired direction.

6. The people mover of claim 5 wherein said people mover further includes at least one handrail; and a handrail drive apparatus driving said handrail in the same direction and at substantially the same speed as said people supporting track.

7. The people mover of claim 6 wherein said drive motor and said drive wheel of each drive apparatus are mounted on a drive shaft pivotally mounted between said supporting structures.

8. The people mover of claim 7 wherein said motor rotor and said drive wheel of each said drive apparatus are mounted for direct rotation to said drive shaft for rotation therewith.

* * * * *

UNITED STATES PATENT AND TRADEMARK OFFICE

CERTIFICATE OF CORRECTION

PATENT NO. : 6,161,674
DATED : December 19, 2000
INVENTOR(S) : Aulanko et al.

It is certified that error appears in the above-identified patent and that said Letters Patent is hereby corrected as shown below:

Title page,
Add the following under Related U.S. Application Data:

-- [60] Provisional application No. 60/012,574, Feb. 29, 1996 --

Signed and Sealed this

First Day of June, 2004

JON W. DUDAS
*Acting Director of the United States Patent and Trademark Office*